US007039971B2

(12) United States Patent
Sebastien

(10) Patent No.: US 7,039,971 B2
(45) Date of Patent: May 9, 2006

(54) HANDLE FOR HOSPITAL BED

(75) Inventor: Gemeline Sebastien, Ploemeur (FR)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 10/506,129

(22) PCT Filed: Mar. 5, 2003

(86) PCT No.: PCT/US03/06877

§ 371 (c)(1),
(2), (4) Date: Aug. 30, 2004

(87) PCT Pub. No.: WO03/075816

PCT Pub. Date: Sep. 18, 2003

(65) Prior Publication Data

US 2005/0120485 A1 Jun. 9, 2005

Related U.S. Application Data

(60) Provisional application No. 60/361,960, filed on Mar. 5, 2002.

(51) Int. Cl.
*A61G 7/053* (2006.01)

(52) U.S. Cl. ..... 5/662; 5/430

(58) Field of Classification Search ..... 5/662, 5/658, 425, 600, 428–430, 602, 621, 623, 5/100, 86.1

See application file for complete search history.

(56) References Cited

U.S. PATENT DOCUMENTS

| | | | | |
|---|---|---|---|---|
| 4,002,330 | A | 1/1977 | Johansson | 5/606 |
| 5,060,327 | A | 10/1991 | Celestina et al. | 5/662 |
| 5,225,403 | A | 7/1993 | Treiber et al. | 514/63 |
| 5,335,385 | A | 8/1994 | Brown | 5/662 |
| 5,802,636 | A | 9/1998 | Corbin et al. | 5/425 |
| 5,806,111 | A | 9/1998 | Heimbrock et al. | 5/86.1 |
| 6,240,583 | B1 | 6/2001 | Brooke et al. | 5/662 |
| 6,668,402 | B1 * | 12/2003 | Heimbrock | 5/600 |
| 6,728,985 | B1 * | 5/2004 | Brooke et al. | 5/662 |
| 2001/0027578 | A1 | 10/2001 | Brooke et al. | 5/662 |
| 2005/0120485 | A1 * | 6/2005 | Sebastien | 5/662 |

* cited by examiner

*Primary Examiner*—Robert G. Santos
(74) *Attorney, Agent, or Firm*—Bose McKinney & Evans LLP

(57) ABSTRACT

A handle (5) is coupled to a frame (8) of a patient support by a bracket (1, 1') and a post (2). The handle (5) includes a locking mechanism (6).

19 Claims, 4 Drawing Sheets

HANDLE FOR HOSPITAL BED

This appln. claims benefit of 60/361,960, filed Mar. 5, 2002.

BACKGROUND AND SUMMARY OF THE INVENTION

The present invention relates to patient supports. More particularly, the present invention relates to a handle on a hospital bed to assist bed ingress and egress.

It is known to provide a handle or an assist arm on a patient support such as a hospital bed, stretcher, table or other support. See, for example, U.S. Pat. Nos. 5,060,327 and 6,240,583 which are incorporated herein by reference. U.S. Provisional Application Ser. No. 60/361,960, filed Mar. 5, 2002, is also expressly incorporated by reference herein.

In an illustrated embodiment, an assist arm is provided for use with a patient support structure having a frame. The assist arm comprises a post attached to the frame and a handle coupled to the post for rotational movement about the post between an upright position and a retracted position. The post includes a first bore having a first depth and a second bore having a second depth that is greater than the first depth. The handle includes a locking mechanism which cooperates with the first and second bores to retain the handle in the retracted position and to lock the handle in the upright position, respectively. The locking mechanism automatically releases the handle from the retracted position when a force is applied on the handle to move the handle toward the upright position.

In another illustrated embodiment, an assist arm is provided for use with a patient support structure having a frame. The assist arm comprises a bracket having a pair of substantially parallel sides connected together by a web, the sides being configured to attach to opposed faces of the frame, a post attached to the bracket, and a handle coupled to the post for rotational movement about the post between an upright position and a retracted position.

In yet another illustrated embodiment, assist arm is provided for use with a patient support structure having a frame defining a footprint. The assist arm comprises a support element having a free end, a hand grip mounted on said free end, and means for removably mounting the support element on a frame of the patient support structure for movement between a vertical operational position and a horizontal stored position below the frame and within the footprint of the frame.

Additional features of the present invention will become apparent to those skilled in the art upon consideration of the following detailed description of embodiments of the invention in conjunction with the associated drawings.

DETAILED DESCRIPTION OF EMBODIMENTS OF THE INVENTION

The embodiments described below are merely exemplary and are not intended to limit the invention to the precise forms disclosed. Instead, the embodiments were selected for description to enable one of ordinary skill in the art to practice the invention.

Figure 1:
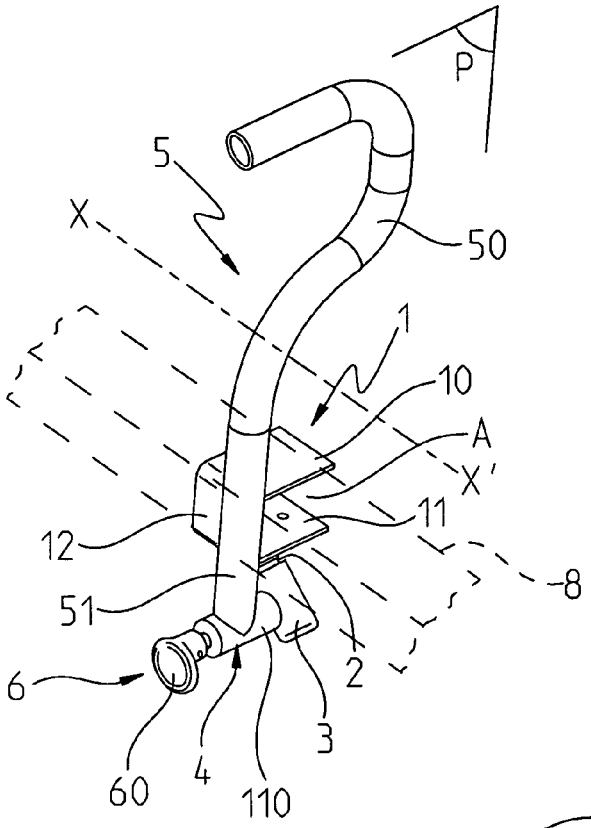
FIG. 1 is a perspective view of a first embodiment of a handle according to the present invention located in an upright position.
Figure 2:
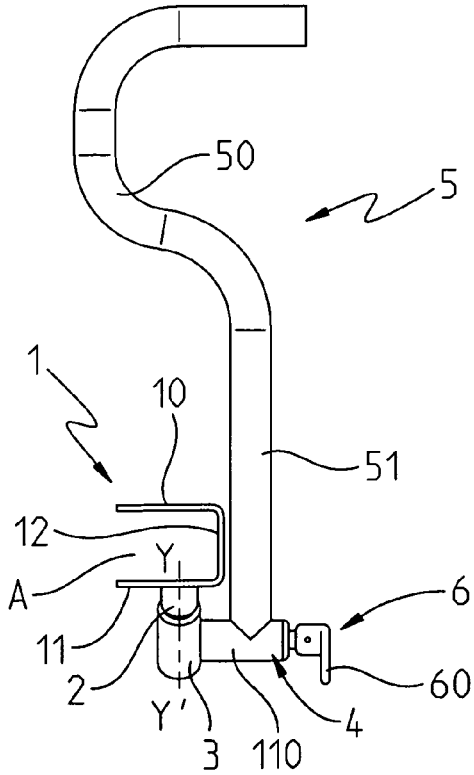
FIG. 2 is a side view of the handle of FIG. 1.

The handle apparatus represented in the figures comprises primarily an attachment bracket 1 and a handle 5. In one illustrated embodiment (FIGS. 1–3) the bracket 1 is a "U"-shaped clamp with two parallel sides 10, 11 and a web 12. Sides 10, 11 form an opening A opposite web 12. In use, sides 10, 11 are attached above and below the upper and lower faces of a frame 8 of a patient support, or bed, with suitable fasteners. Thus, frame 8 is received within opening A of bracket 1. Sides 10, 11 thus extend (along their widths) parallel to a longitudinal axis X–X' of the bed.

Figure 3:
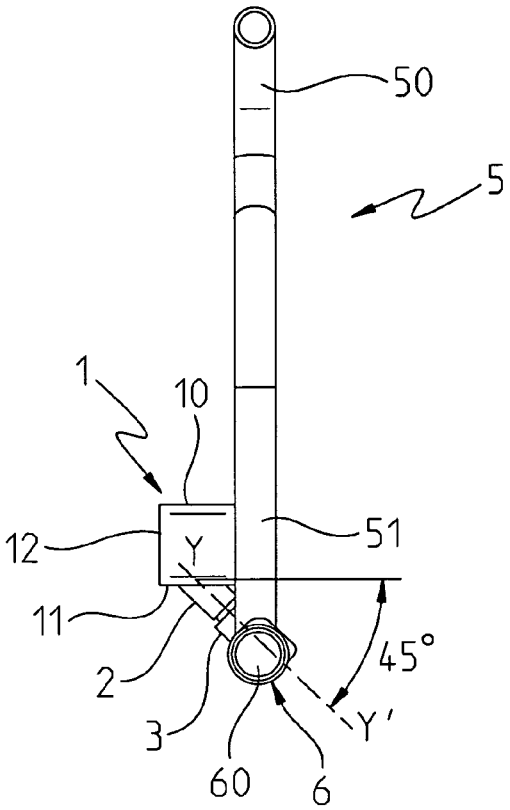
FIG. 3 is an end view of the handle of FIG. 1.

A lower face of side 11 is fixedly connected to a post 2, that extends along a longitudinal axis Y–Y', forming an angle, for example, of 45° relative to sides 10, 11 as best shown in FIG. 3. A tubular sleeve 3 rotatably engages post 2. Sleeve 3 is fixedly connected to a tube 4 that extends radially from sleeve 3 in a substantially perpendicular orientation relative thereto. In the upright position of FIGS. 1–3, tube 4 extends in the opposite direction of opening A. On the interior of tube 4 is assembled a locking mechanism 6 as is further described below. An external wall 110 of tube 4 is radially fixed to a foot portion 51 of handle 5. A grip portion 50 extends from foot portion 51. Grip portion 50 is intended to be used by the occupant of the bed to support the occupant when entering and exiting the bed. Handle 5 may be formed into any of a variety of different shapes.

In the embodiment of FIGS. 4–7, bracket 1' also is an attachment bracket, but its sides 10' and 11' extend vertically for attachment to the corresponding vertical faces of a frame 8. Thus, opening A' extends upwardly. The horizontal web 12' includes a horizontal extension 13', to which post 2 is fixed.

Figure 8:
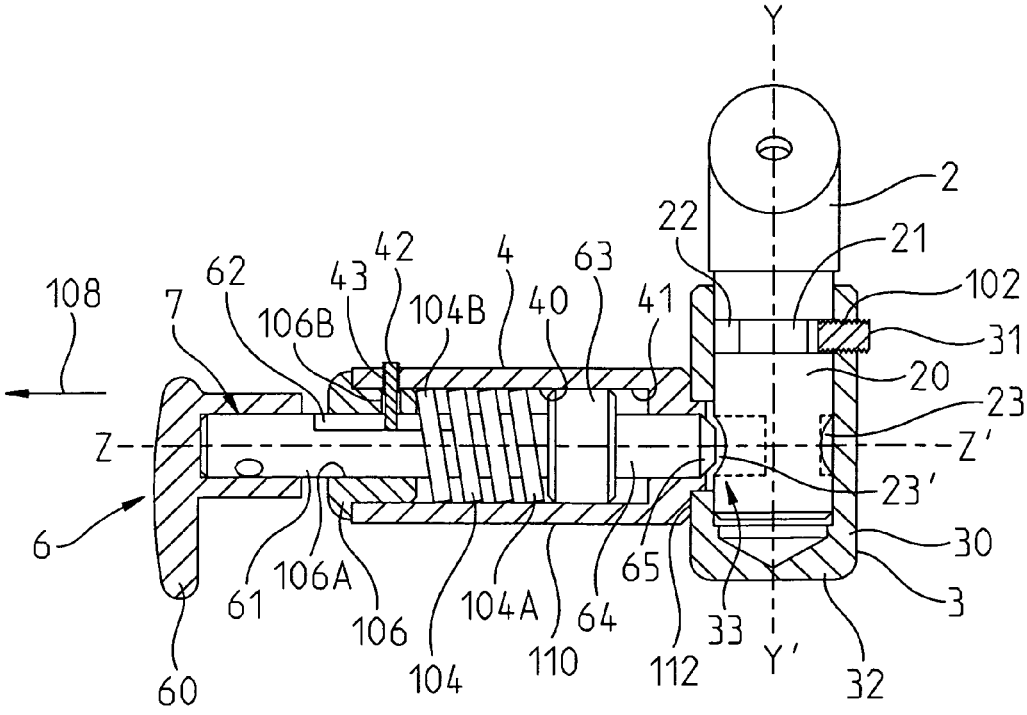
FIG. 8 is a cross-sectional view of a portion of the handle of FIG. 7.

As shown in FIG. 8, post 2 includes a substantially cylindrical body 20 that extends along axis Y–Y'. Near one end of body 20 is an annular groove 22. Groove 22 defines an area 21 of reduced diameter relative to the diameter of other portions of body 20. Two bores 23, 23' are formed into body 20 adjacent its other end. Bores 23, 23' are aligned with one another on opposite sides of body 20 (i.e., 180 degrees of separation). Bores 23, 23' are of substantially identical diameter. First bore 23 is relatively shallow (for example, about 1.5 mm), while second bore 23' is deeper (for example about 8 mm).

Sleeve 3 includes a body 30 that is rotatably engaged on post 2. The interior diameter of body 30 corresponds, except for tolerances, to an external diameter of cylindrical body 20 of post 2. Body 30 includes a threaded opening 102 for receiving a screw 31 that engages groove 22 of post 2 when threaded sufficiently into opening 102. Since groove 22 extends only half way around the circumference of post 2, screw 31 limits the translation and rotation of sleeve 3 relative to post 2. Body 30 further includes a circular opening 33 that, depending upon the rotational position of sleeve 3, may align with one or the other of bores 23, 23'.

Tube 4 is hollow, having a bore 40 defined therein. End wall 112 of tube 4 includes an opening 41 of reduced diameter that communicates with the opening 33 of body 30.

Locking mechanism 6 extends into bore 40 of tube 4. Locking mechanism 6 includes a bolt 7 extending into bore 40 and having a body 61 and an end 64 of substantially identical diameter generally corresponding to the internal diameter of opening 41. However, in other embodiments, these diameters of body 61 and end 64 could be different. Tip 65 of end 64 is chamfered. An intermediate guide portion 63 is disposed on body 61. The outer diameter of guide portion 63 corresponds to the interior diameter of bore 40. A spring 104 is positioned onto body 61, having an outer diameter that substantially corresponds to the interior diameter of bore 40. Spring 104 includes a first end 104A that engages guide portion 63 and a second end 104B that engages a stopper 106. Stopper 106 is placed in bore 40 at the end of tube 4 opposite end wall 112. Stopper 106 includes a central opening 106A to receive body 61 and a side opening 106B to receive a screw post 42. An axial groove 62 is formed in body 61, also for receiving screw post 42, which extends through a threaded opening 43 formed in tube 4. Screw post 42 and groove 62 limit axial displacement of bolt 7 in tube 4. Screw post 42 and groove 62 also prevent rotation of bolt 7 about the axis Z–Z'of tube 4.

Locking mechanism 6 also includes a knob 60 attached to body 61 of bolt 7. By pulling on knob 60 (in the direction of arrow 108), the user compresses spring 104 between stopper 106 and guide portion 63, and retracts tip 65 of end 64 out of opening 33 of sleeve 3. When knob 60 is released, spring 104 urges bolt 7 back into its initial position. When handle 5 is in the retracted position (FIG. 5), tip 65 of end 64 is located in bore 23. Since bore 23 is relatively shallow, bolt 7 is simply indexed (i.e., weakly locked) in the retracted position. As such, handle 5 may be moved out of the retracted position without requiring activation of locking mechanism 6 by pulling knob 60. The indexing, however, is sufficiently strong to prevent handle 5 from simply falling out of the retracted position as a result of, for example, vibration associated with movement of the bed.

Figure 4:
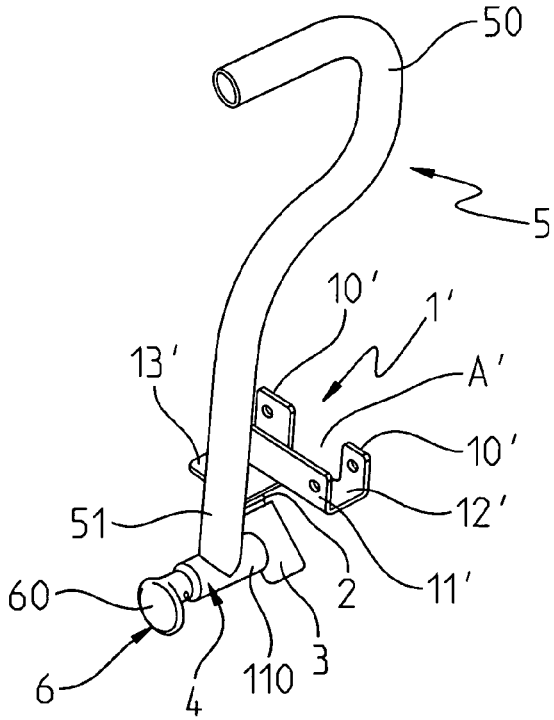
FIG. 4 is a perspective view similar to FIG. 1, showing a second embodiment of handle according to the present invention located in an upright position.
Figure 5:
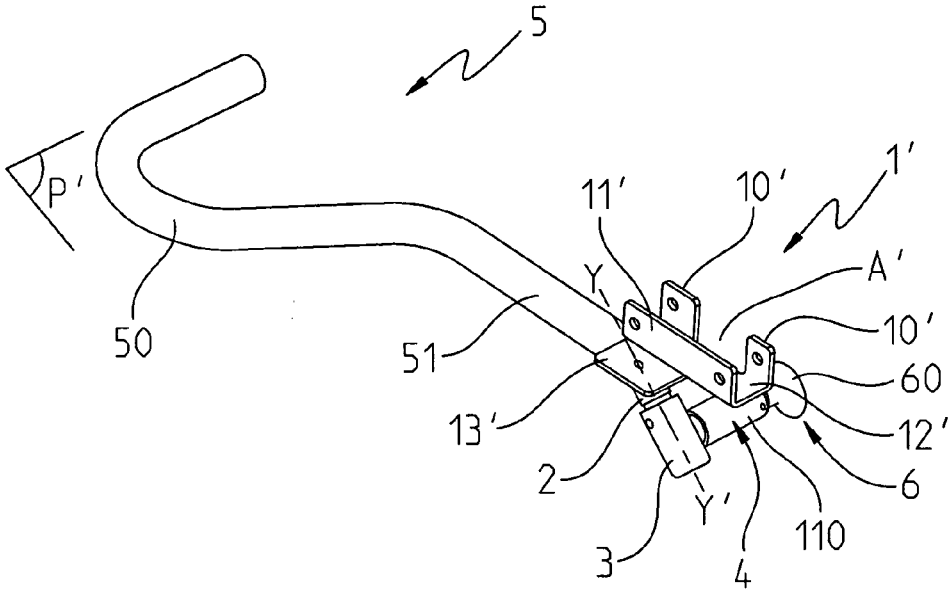
FIG. 5 is a perspective view of the handle of FIG. 4 in a retracted position.
Figure 6:
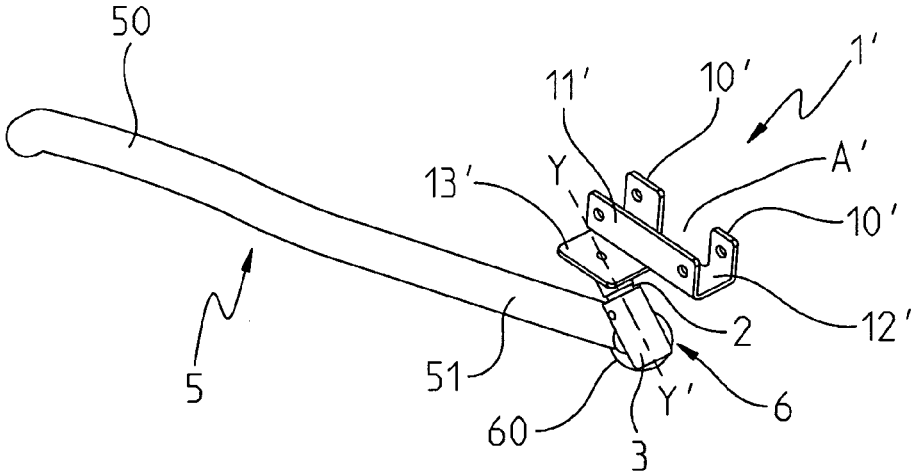
FIGS. 6 and 7 are perspective views of the handle of FIG. 4 in intermediate positions.
Figure 7:
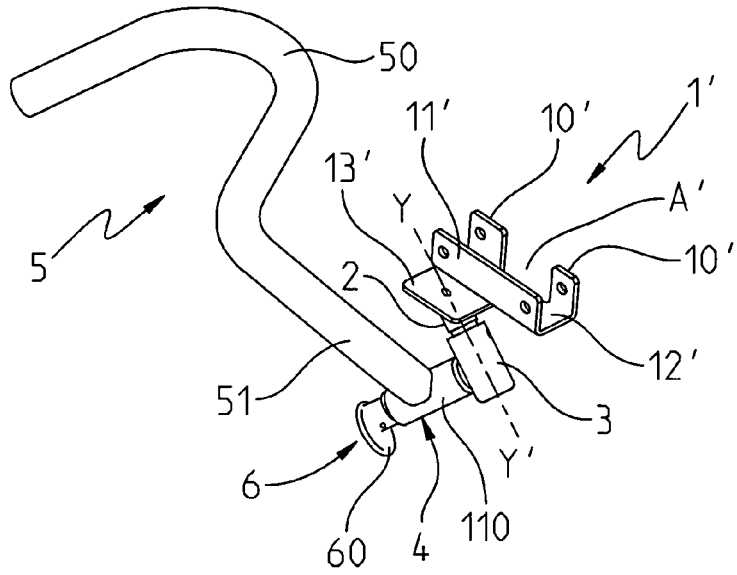

To move handle 5 from the retracted position of FIG. 5 in which handle 5 is substantially contained in a plane P' parallel to the ground when the frame is in a flat position, to an upright position (FIG. 4), the user grasps grip portion 50 of handle 5 and begins rotational movement about axis Y–Y'. This movement disengages tip 65 from bore 23. During further rotation of handle 5 about axis Y–Y', as shown in FIGS. 6 and 7, tip 65 slides on cylindrical body 20 of post 2. After swiveling 180°, the upright position of FIG. 4 is reached, and tip 65 engages and is received by second bore 23' under the biasing force of spring 104, thus locking handle 5. When in the upright position, the handle 5 is substantially contained in a plane (not pictured) substantially perpendicular to the plane P'.

To return to the retracted position, the user illustratively pulls out on knob 60 and rotates handle 5 about axis Y–Y' in an opposite direction. In the retracted position, the handle 5 is located below the frame 8 and also within a footprint defined by the frame 8. Therefore, the handle 5 may be stored in an out-of-the-way position on the patient support, or removed entirely by uncoupling the bracket 1 or 1' from the frame 8.

In an embodiment not shown, bracket 1 or 1' is eliminated and post 2 is attached directly to a lower face of frame 8 of the patient support.

Although the invention has been described in detail with reference to specific embodiments, variations and modifications exist within the scope and spirit of the invention as described and defined in the following claims.

The invention claimed is:

1. An assist arm for use with a patient support structure having a frame, the assist arm comprising:

a post attached to the frame, the post including a first bore having a first depth and a second bore having a second depth that is greater than the first depth; and a handle coupled to the post for rotational movement about the post between an upright position and a retracted position, the handle including a locking mechanism which cooperates with the first and second bores to retain the handle in the retracted position and to lock the handle in the upright position, respectively, the locking mechanism automatically releasing the handle from the retracted position when a force is applied on the handle to move the handle toward the upright position.

2. The assist arm of claim 1, wherein the locking mechanism rotates with the handle.

3. The assist arm of claim 1, further comprising a bracket coupled to the post to removably attach the post and the handle to the frame.

4. The assist arm of claim 1, wherein the frame defines a plane, and the post defines a longitudinal axis that forms about a 45-degree angle relative to the plane of the frame.

5. The assist arm of claim 1, wherein the post is received within the handle.

6. The assist arm of claim 1, wherein the locking mechanism includes a locking bolt and a spring configured to bias the locking bolt against the post so that the bolt engages the first and second bores when aligned therewith.

7. The assist arm of claim 1, further comprising an actuator to selectively release the locking mechanism when the handle is in the locked upright position.

8. The assist arm of claim 1, wherein the frame defines a footprint and the handle is located below the frame and within the footprint of the frame when the handle is in the retracted position.

9. An assist arm for use with a patient support structure having a frame, the assist arm comprising:

a bracket having a pair of substantially parallel sides connected together by a web, the sides being configured to attach to opposed faces of the frame;

a post attached to the bracketT, wherein the post defines a longitudinal axis that is aligned at a 45 degree angle with respect to the sides of the bracket; and a handle coupled to the post for rotational movement about the post between an upright position and a retracted position.

10. The assist arm of claim 9, wherein the post is received within the handle.

11. The assist arm of claim 9, wherein the handle is located below the frame when the handle is in the retracted position.

12. The assist arm of claim 11, wherein the handle is located within a footprint defined by the frame when the handle is in the retracted position.

13. The assist arm of claim 9, wherein the handle is located in a first plane when the handle is in an upright position and the handle is located in a second plane when the handle is in a retracted position, the first plane being perpendicular to the second plane.

14. An assist arm for use with a patient support structure having a frame, the assist arm comprising:

a bracket having a pair of substantially parallel sides connected together by a web, the sides being configured to attach to opposed faces of the frame;

a post attached to the bracket; and a handle coupled to the post for rotational movement about the post between an upright position and a retracted position wherein the post includes a first bore having a first depth and a second bore having a second depth that is greater than the first depth, and the handle includes a locking mechanism which cooperates with the first and second bores to retain the handle in the retracted position and to lock the handle in the upright position, respectively, the locking mechanism automatically releasing the handle from the retracted position when a force is applied on the handle to move the handle toward the upright position.

15. An assist arm for use with a patient support structure having a frame defining a footprint, the assist arm comprising:

a support element having a free end;

a hand grip mounted on the free end;

means for removably mounting the support element on a frame of the patient support structure for movement between a vertical operational position and a horizontal stored position below the frame and within the footprint of the frame; and means for retaining the support element in the operational position and the stored position, including a first bore having a first depth, to retain the support element in the stored posItion, and a second bore having a second depth that is greater than the first depth, to retain the support element in the stored posItion.

16. The assist arm of claim 15, wherein the mounting means includes a bracket having a pair of substantially parallel sides connected by a web and a fastener for coupling the bracket to the frame.

17. The assist arm of claim 16, wherein the retaining means locks the support element in the vertical operational position and applies a retention force on the support element when the support element is in stored position.

18. The assist arm of claim 15, further comprising an actuator configured to release the retaining means and permit the support element to be moved from the operational position to the stored position.

19. An assist arm for use with a patient support structure having a frame, the assist arm comprising:

a post attached to the frame, the post including a first bore having a first depth and a second bore having a second depth that is greater than the first depth; and a handle coupled to the post for rotational movement about the post between a first position and a second position, the handle including a locking mechanism which cooperates with the first and second bores to retain the handle in the first position and to lock the handle in the second position, respectively, the locking mechanism automatically releasing the handle from the first position when a force is applied on the handle to move the handle toward the second position.

* * * * *